US006499155B1

(12) United States Patent
Barrios

(10) Patent No.: US 6,499,155 B1
(45) Date of Patent: Dec. 31, 2002

(54) TOILET FLUSH HANDLE PROTECTOR AND DISPENSING MECHANISM

(76) Inventor: Gary Barrios, 603 Merioneth NE. Rd., Fort Walton Beach, FL (US) 32547

( * ) Notice: Subject to any disclaimer, the term of this patent is extended or adjusted under 35 U.S.C. 154(b) by 0 days.

(21) Appl. No.: 09/875,109

(22) Filed: Jun. 7, 2001

(51) Int. Cl.[7] ..... E03D 5/00
(52) U.S. Cl. ..... 4/661; 4/249; 221/310
(58) Field of Search ..... 4/661, 249, 405, 4/DIG. 18; 221/310

(56) References Cited

U.S. PATENT DOCUMENTS 3,435,988 A * 4/1969 Jonas et al.
3,549,226 A * 12/1970 Samson ..... 4/661
3,625,654 A * 12/1971 Van Duyne ..... 4/661
4,484,694 A * 11/1984 Reuteman et al.
4,856,140 A * 8/1989 Visco et al. ..... 4/405
5,125,577 A * 6/1992 Frankel ..... 4/661
5,640,722 A * 6/1997 Bui ..... 4/661
6,138,292 A * 10/2000 O'Toole ..... 4/405

* cited by examiner

*Primary Examiner*—Charles R. Eloshway
(74) *Attorney, Agent, or Firm*—William B. Noll

(57) ABSTRACT

A disposable, toilet flush handle protection device, and mountable dispensing mechanism for minimizing the spread of germs in public facilities, from one user to another. The device comprises an elongated disposable tubular member of a diametric size to be removably placed on and off a conventional, perpendicularly mounted flush handle member of a toilet. A first end of the device is closed, while the second end includes an outwardly flared portion, where the flared portion is preferably formed by plural longitudinal slots to segment the second end. The dispensing mechanism comprises a semi-rigid tube, such as may be formed of a thin walled plastic, open at the top end for receiving a plurality of nestable devices, and open at the bottom end. The bottom end includes an inwardly directed flange to selectively contact and temporarily retain the flared portions of the devices so as to limit the dispensing of a single device at desired intervals.

7 Claims, 1 Drawing Sheet

TOILET FLUSH HANDLE PROTECTOR AND DISPENSING MECHANISM

FIELD OF THE INVENTION

This invention is directed to sanitizing devices and a dispensing mechanism of the type that may be used in public facilities to minimize the transfer of germs from other users of such facilities.

BACKGROUND OF THE INVENTION

The present invention relates to a disposable toilet flush handle protector and dispensing mechanism that has particular utility in public restrooms to prevent or minimize the spread of germs, in such facilities as one may find on interstate highways and shopping centers.

In today's society we are familiar with a variety of sanitizing devices, such as sprays and cleansers, which are common products in one's household. All to often we are reminded by numerous TV commercials of the problem and spread of germs in the home, where the control thereof is a primary focus of home owners, especially those with children. Unfortunately, we don't have the same control over public facilities despite attempts by the operators thereof to provide safe and clean facilities. At least one area of concern to those operators is to provide throw away toilet seat protectors, or other means of protection. In this regard the prior art offers a number of devices or practices to minimize one's contact with the seat of a toilet. The following U.S. patents illustrate some of such devices or practices:

a.) No. 1,563,236, to Smith, teaches a portable toilet seat which utilizes a pair of U-shaped pivotal legs, pivotal from the underside of a circular toilet seat.

b.) U.S. Pat. No. 1,379,374, to Wagner, relates a folding chair having a seat with a central commode opening, and four individually pivotal legs.

c.) U.S. Pat. No. 1,223,065, to Meyer, discloses a portable toilet seat similar to that taught by Smith.

d.) U.S. Pat No. DE 1,051,467, to Elgin, teaches a child's fixed stool which is adapted to be positioned over a conventional toilet.

A very recent patent, though still one addressing the concern of the spread of germs associated with toilet seats of public restrooms, is U.S. Pat. No. 6,000,068, to Chavis. The patent is directed to a portable and removable commode seat that comprises a commode seat and a series of extendable and foldable legs secured to the commode seat and extending therefrom. When the legs are extended generally vertically from the commode seat, the commode seat can be placed over a conventional commode and utilized without the person ever coming in contact with the underlying fixed commode. After use, the legs can be folded to extend adjacent the underside of the commode seat for convenient handling or storage. A modification thereof is a commode seat having plural J-shaped supports to rest on and be supported by the conventional commode. In each case, a preferred feature is the provision of plural, thin, peelable and removable sheets of paper, or other suitable material, overlying the seating surface to allow the user thereof to expose a fresh and germ free surface when desired.

Unfortunately the foregoing prior art deals only with the single source of germs, and the protection thereagainst, that one can encounter in a public facility. A secondary source of germs, and the spread thereof, but which has received no recognition, is the flush handle of a toilet. Typically, especially in public facilities, toilet flush handles comprise a depressible, elongated handle that is manually operated by the user. With thousands of flushes per month at popular highway rest sites, and only periodic cleansing and possible sanitizing, germs can easily spread, germinate and present major problems to those who follow. This invention addresses the latter concern by providing a disposable sleeve member, and dispenser, that insulates the user from the potential germs which may be present on the flush handle. The manner by which this invention meets this secondary source of germs will become apparent in the description which follows, particularly when read in conjunction with the accompanying drawings.

SUMMARY OF THE INVENTION

This invention relates to a disposable, toilet flush handle protection device and mountable dispensing mechanism therefore, where the device has particular utility for minimizing the spread of germs in public facilities, from one user to another. The device comprises an elongated tapered disposable tubular member of a diametric size to be slidably received onto and off a conventional, perpendicularly mounted flush handle member. A first end of the device is closed, while the second end includes an outwardly flared portion, where the flared portion is preferably formed by plural longitudinal slots to segment the second end. The dispensing mechanism comprises a semi-rigid tube, such as may be formed of a thin walled plastic, open at the top end for receiving a plurality of nestable said devices, and open at the bottom end. The bottom end includes an inwardly directed flange to selectively contact and temporarily retain the flared portions of the devices so as to limit the dispensing of a single said device at selected intervals.

Accordingly, an object of this invention is to give comfort and security to users of the invention against the spread of germs in public restroom facilities.

Another object hereof is the provision of disposable, biodegradable items that protect users thereof against the spread of germs, without adversely impacting the environment.

A further object of the invention is a convenient and simple dispensing mechanism that can be readily mounted to a wall or other fixed structure within easy reach of the user.

These and other objects will become more apparent in the description which follows, especially by those skilled in the art, when read in conjunction with the accompanying drawings.

DETAILED DESCRIPTION OF PREFERRED EMBODIMENT

Figure 1:
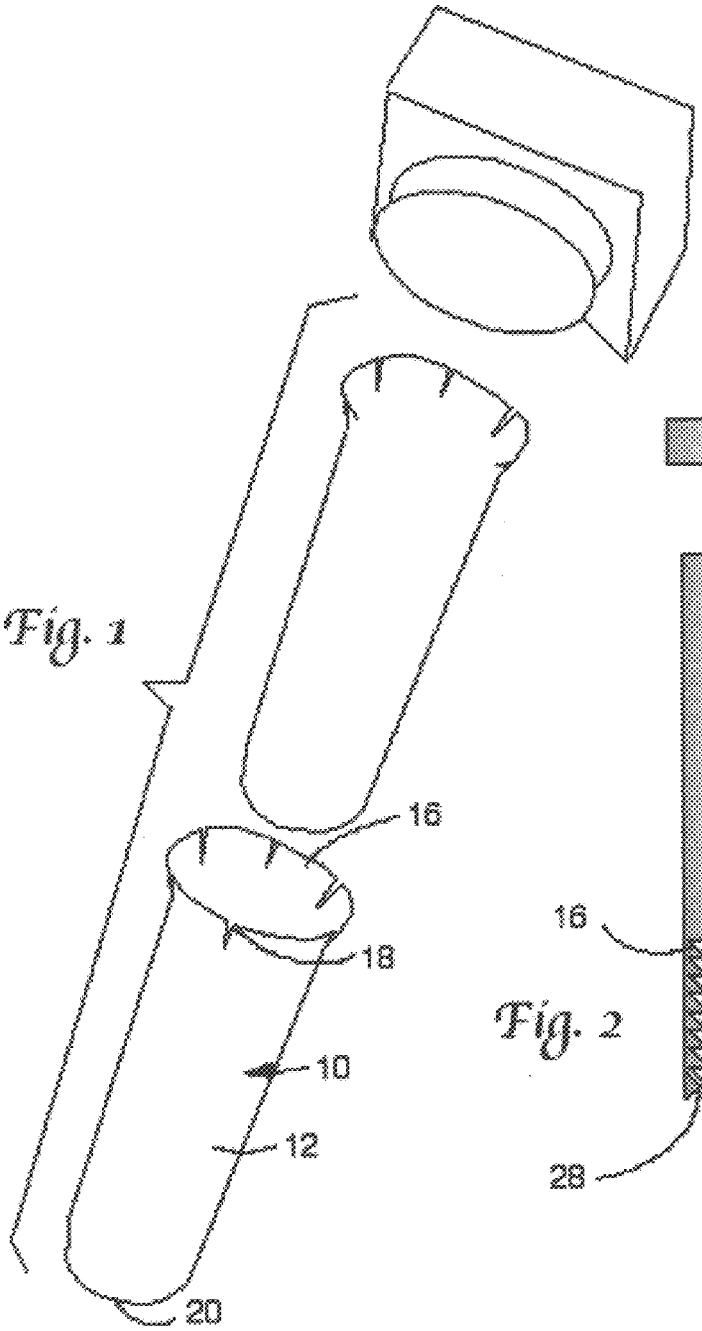
FIG. 1 is a perspective view of the disposable toilet flush handle protector and dispensing mechanism according to the invention, where said toilet flush protector is shown poised for entry onto a conventional flush handle.

The present inventiopn is directed to a disposable, tapered toilet flush protection device, and to a mountable dispensing mechanism into which a plurality of said devices are nested, with means to selectively dispense a single said device as desired. The invention will now be described with regard to the accompanying two Figures, where like reference numerals represent like components or features in the two views.

FIG. 1 illustrates a perspective view of the disposable, tapered toilet flush protection device 10 of the invention, where the device comprises an elongated body 12 extending from an open end 14, featuring plural, outwardly flared portions 16, formed by plural longitudinal slots 18, and a closed end 20. For reasons described later, the elongated body 12 is tapered from the open end 14 to the closed end 20. To avoid problems, and to minimize the impact on the environment, the tapered, elongated body 12 is formed of a biodegradable material, such as paper or lightweight cardboard.

FIG. 1 further illustrates the use of the device 10 according to the invention. As typically found in public restrooms, toilets include flush handles, such as shown in the Figure, and may comprise an elongated handle having a balled, rotary end that may by pivoted manually in any radial direction to activate the flushing operation. As noted previously, the handle is moved by hand contact, and because of the nature of the function, germs may fester on the handle to be spread to the next user. The device 10 hereof helps to protect the user against the spread of germs by providing a temporary protective cover.

Figure 2:
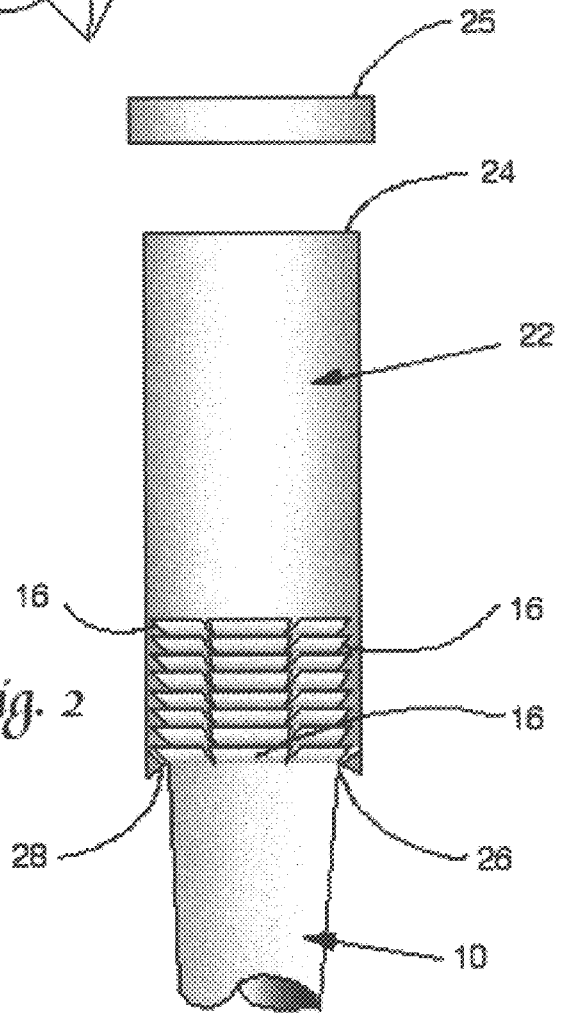
FIG. 2 is an enlarged, partial perspective view of the dispensing mechanism of this invention, with parts removed to show certain internal details, further showing a series of nestable toilet flush handle protectors of the invention.

FIG. 2 is an enlarged dispensing mechanism 22 that can be mounted to a wall or other convenient structure convenient to the user. The mounting mechanism, though not shown, may be by the use of a double sided tape, complementary hook and pile type fastening strips, known commercially as VELCRO (a trademark) strip fasteners, or by a bracket, as known in the art. In any case, the dispensing mechanism 22 is tubular in configuration and is diametrically sized to slidably receive plural said devices 10. The top end 24 is open to easily position the plural said devices 10, but may be provided with a removable cover member 25.

The lower end 26 is open and includes an inwardly directed flange 28 that helps to selectively limit the removal of a single said device 10. That is, the flexible flared portions 16 initially contact the flange 28 to temporarily retain the lower most device 10 until released by manually pulling on the lower most said device 10, note FIG. 2. Note further in the Figure the fact that plural said devices, by virtue of the tapered shape, are nestable so as to accommodate a plurality of the devices to minimize refilling of the dispensing mechanism.

It is recognized that variations, changes and modifications may be made to the device and dispensing mechanism of this invention, without departing from the spirit and scope thereof. Accordingly, no limitation is intended to be imposed thereon except as set forth in the accompanying claims.

What is claimed is:

1. A disposable toilet flush handle protector and mountable dispensing mechanism, to minimize the spread of germs from one user to another, said toilet flush handle protector comprising an elongated tapered disposable tubular member of a diameter to be slidably received onto and off a flush handle member, where a first end thereof is closed and a second end includes an outwardly flared portion formed by a plurality of spaced-apart longitudinally directed slots to segment said flared portion; and said dispenser mechanism comprising a semi-rigid tube open at the top end for receiving a plurality of nestable said disposable tubular members, and open at the bottom end thereof, where said bottom end includes an inwardly directed flange to selectively contact said flared portions to limit the dispensing of a single said tubular member at selected intervals.

2. The disposable toilet flush handle protector and mountable dispensing mechanism according to claim 1, wherein said flange is a continuous annular member.

3. The disposable toilet flush handle protector and mountable dispensing mechanism according to claim 1, wherein said disposable tubular member is formed of a paper sleeve.

4. The disposable toilet flush handle protector and mountable dispensing mechanism according to claim 1, wherein said disposable tubular member is formed of a cardboard sleeve.

5. The disposable toilet flush handle protector and mountable dispensing mechanism according to claim 1, wherein said semi-rigid tube includes a removable cover for said top end.

6. The disposable toilet flush handle protector according to claim 1, where said flange is sufficiently sized to retain said nestable tubular members within said semi-rigid tube, where a downward axial pressure on the lowermost said nested tubular member will only release said nested tubular member through said bottom end.

7. The disposable toilet flush handle protector according to claim 1, wherein said tubular members are tapered from the open end to the closed end.

* * * * *